US010186365B2

(12) United States Patent
Ashizawa et al.

(10) Patent No.: US 10,186,365 B2
(45) Date of Patent: Jan. 22, 2019

(54) INDUCTOR

(71) Applicant: TDK CORPORATION, Tokyo (JP)

(72) Inventors: Syun Ashizawa, Minato-ku (JP); Toshio Tomonari, Minato-ku (JP); Hirohumi Asou, Minato-ku (JP); Emi Ito, Tsuruoka (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/446,321

(22) Filed: Mar. 1, 2017

(65) Prior Publication Data

US 2017/0263372 A1 Sep. 14, 2017

(30) Foreign Application Priority Data

Mar. 10, 2016 (JP) ..... 2016-047117

(51) Int. Cl.

| | |
|---|---|
| ***H01F 17/04*** | (2006.01) |
| ***H01F 27/30*** | (2006.01) |
| ***H01F 27/29*** | (2006.01) |
| ***H01F 27/28*** | (2006.01) |

(52) U.S. Cl.

CPC ..... *H01F 27/2823* (2013.01); *H01F 27/29* (2013.01)

(58) Field of Classification Search

CPC ..... H01F 27/2823; H01F 27/29
USPC ..... 336/207, 208
See application file for complete search history.

(56) References Cited

U.S. PATENT DOCUMENTS

2006/0196984 A1* 9/2006 Higeta ..... H01F 27/2823 242/176
2014/0167903 A1* 6/2014 Tomonari ..... H01F 17/045 336/220

FOREIGN PATENT DOCUMENTS

JP 2011-082463 A 4/2011

* cited by examiner

*Primary Examiner* — Ronald Hinson
(74) *Attorney, Agent, or Firm* — Oliff PLC

(57) ABSTRACT

A coil device includes a winding core with a coil portion wound by a wire and a pair of flanges respectively formed on both sides of the winding core in an axial direction. The coil portion includes a bank winding portion with double layer constituted by the wire wound around an outer circumference of the winding core and a layer winding portion with single layer constituted by the wire wound closely and adjacently to the bank winding portion along the axial direction of the winding core.

2 Claims, 5 Drawing Sheets

Prior Art

INDUCTOR

BACKGROUND OF THE INVENTION

1. Field of the Invention

The present invention relates to a coil device used as an inductor, for example.

2. Description of the Related Art

The most fundamental method for enhancing inductance in coil devices is increasing turn number of a wire (winding number of a wire), and a multilayer winding structure is preferably employed particularly in view of downsizing of the coil devices. In a conventional multilayer winding structure, inductance may be adjusted by winding a wire that cannot be wound in a first layer in a second layer.

When the wire that cannot be wound in the first layer is rewound in the second layer, however, the wire is wound in a third layer so that a lead end of the wire goes to a terminal formed on a flange. A self-resonant frequency is conventionally hard to shift to the side of high frequency due to increase in inter-line capacity or so.

Incidentally, the technique shown in Patent Document 1 is known, and the invention of Patent Document 1 can shift a self-resonant frequency to the side of low frequency, but a self-resonant frequency is still hard to shift to the side of high frequency.

SUMMARY OF THE INVENTION

The present invention has been achieved under such circumstances. It is an object of the invention to provide a coil device capable of shifting a self-resonant frequency to the side of high frequency.

To achieve the object, the coil device according to the present invention is a coil device including:

a winding core with a coil portion wound by a wire; and a pair of flanges respectively formed on both sides of the winding core in an axial direction, wherein the coil portion includes a bank winding portion with double layer constituted by the wire wound around an outer circumference of the winding core and a layer winding portion with single layer constituted by the wire wound closely and adjacently to the bank winding portion along the axial direction of the winding core.

In the coil device according to the present invention, the bank winding portion with double layer and the layer winding portion with single layer are combined in the axial direction, and inductance can be thus improved in comparison with a coil device having only a layer winding portion entirely composed of single layer along an axial direction. In addition, the coil device of the present invention can shift a self-resonant frequency to the side of high frequency.

The reason why a self-resonant frequency can be moved to the side of high frequency in the coil device of the present invention is not necessarily clear, but can be explained as below.

In the coil device according to the present invention, the wire is not closely wound around the outer circumference of the winding core in the first layer and then transferred to the second layer, but the bank winding portion is formed by performing a bank winding at the start of winding the wire, at the end of winding the wire, or in the middle of winding the wire in the first layer. In the bank winding, the wire is closely wound by two turns in the first layer, a winding portion is then formed by one turn in the second layer between the wire winding portions of two turns, the wire is rewound by one turn in the first layer, and a winding portion is formed by one turn in the second layer. The bank winding portion is formed by repeating these operations.

In the double bank winding portion, the wire can be wound around the outer circumference of the winding core along an advancing direction of a winding axis by repeating the turns in the second layer and the turns in the first layer. In the single layer winding, the wire can be continuously and closely wound around the outer circumference of the winding core along the advancing direction of the winding axis. Thus, unlike a conventional coil device where a wire is wound in a second layer after continuously forming a first layer, a wire winding portion in a third layer does not need to be formed in the winding portion of the wire going from one of the pair of flanges arranged on both sides in the axial direction of the winding core to the other. It is thus conceivable that the coil device of the present embodiment can reduce an inter-line capacity even in case of the same winding number and shift a self-resonant frequency (SRF) to the side of high frequency.

Preferably, the bank winding portion is close to at least one of the flanges. In the vicinities of the flanges, the flanges function as a wall, the bank winding for forming the bank winding portion is easily performed, and a continuous winding operation is easily made without winding collapse.

Preferably, the coil portion includes the bank winding portion, the layer winding portion, and the bank winding portion in this order along the axial direction of the winding core from one of the flanges to near the other flange. This configuration facilitates a continuous winding operation.

Preferably, an axial length of one of the bank winding portions and an axial length of the other bank winding portion are approximately the same. In this configuration, the flow of the electric current from one side to the other side of the individual wire constituting the coil portion and the flow of the electric current from the other side to one side of the wire are approximately the same, and thus the coil device has no directionality and has an improved usability.

DESCRIPTION OF THE PREFERRED EMBODIMENTS

Hereinafter, the present invention will be described based on an embodiment shown in the figures.

Figure 1A:
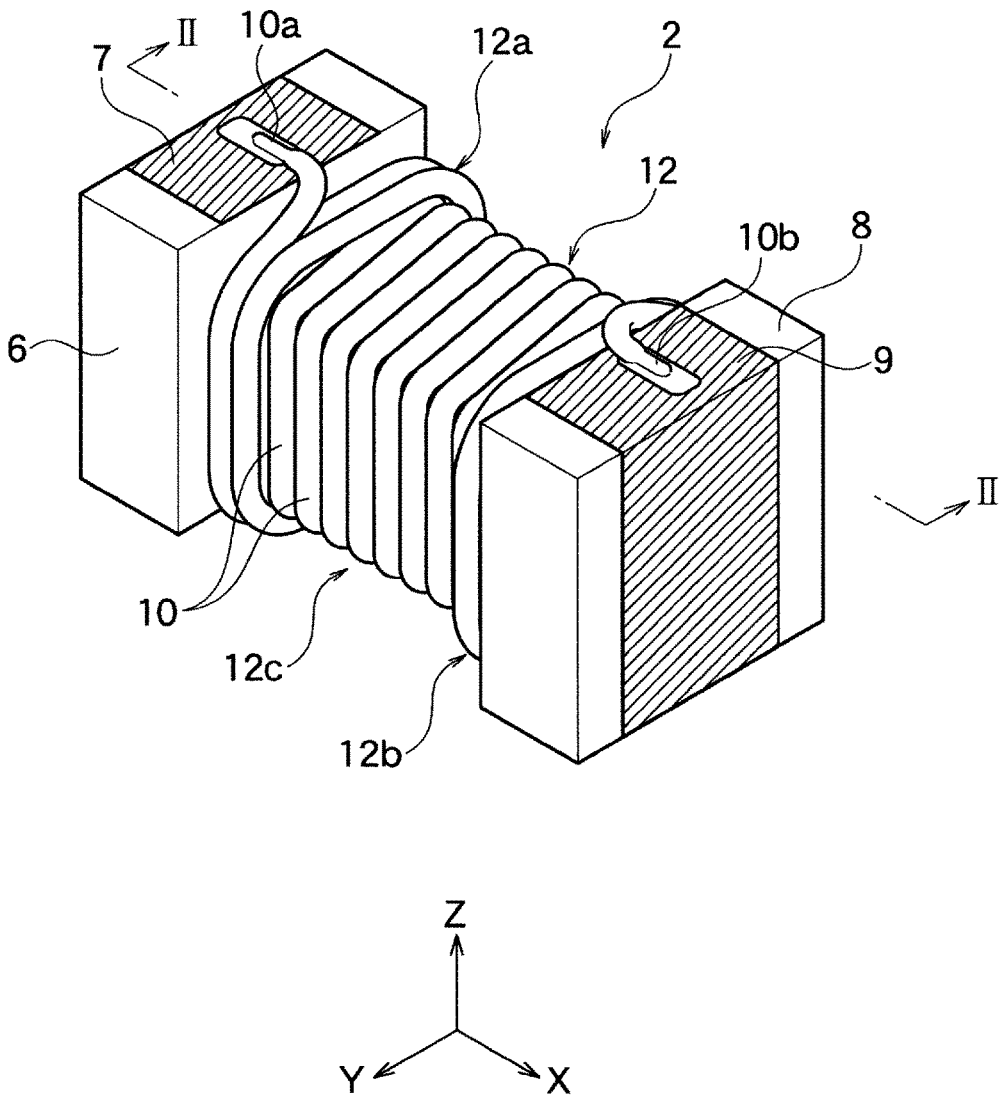
FIG. 1A is a perspective view of a coil device according to an embodiment of the present invention.
Figure 1B:
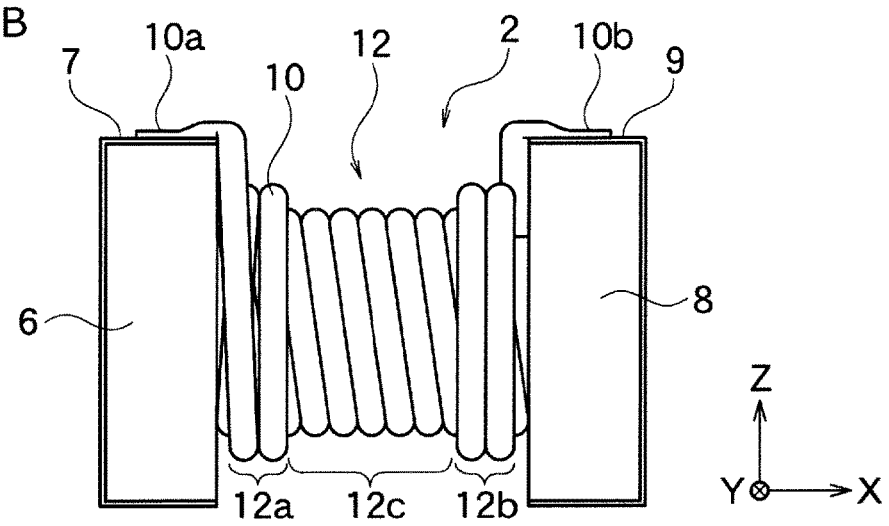
FIG. 1B is a front view of the coil device shown in FIG. 1A.
Figure 1C:
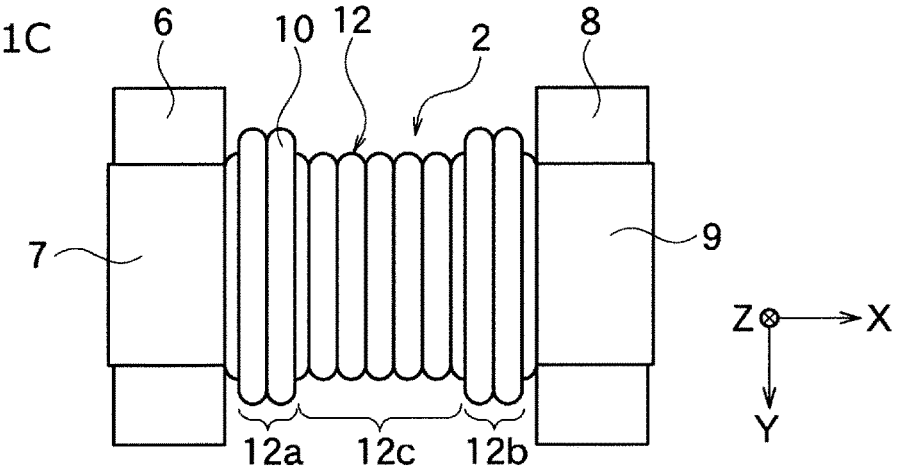
FIG. 1C is a bottom view of the coil device shown in FIG. 1A.
Figure 1D:
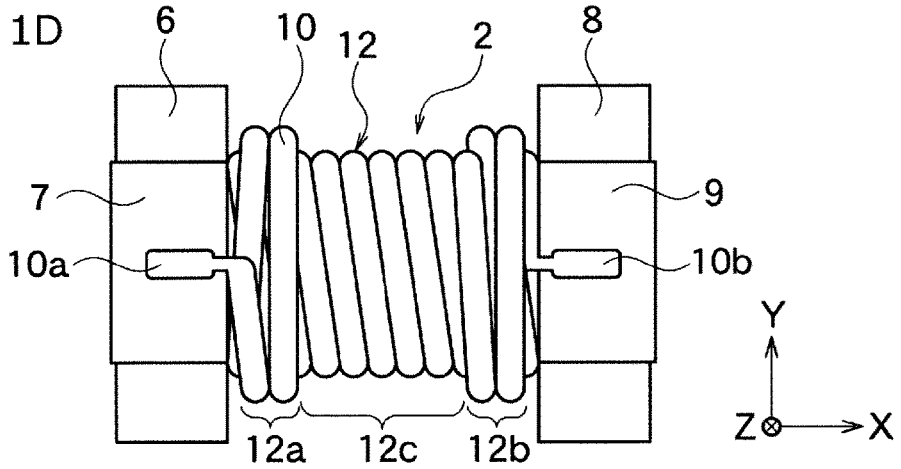
FIG. 1D is a plane view of the coil device shown in FIG. 1A.
Figure 2A:
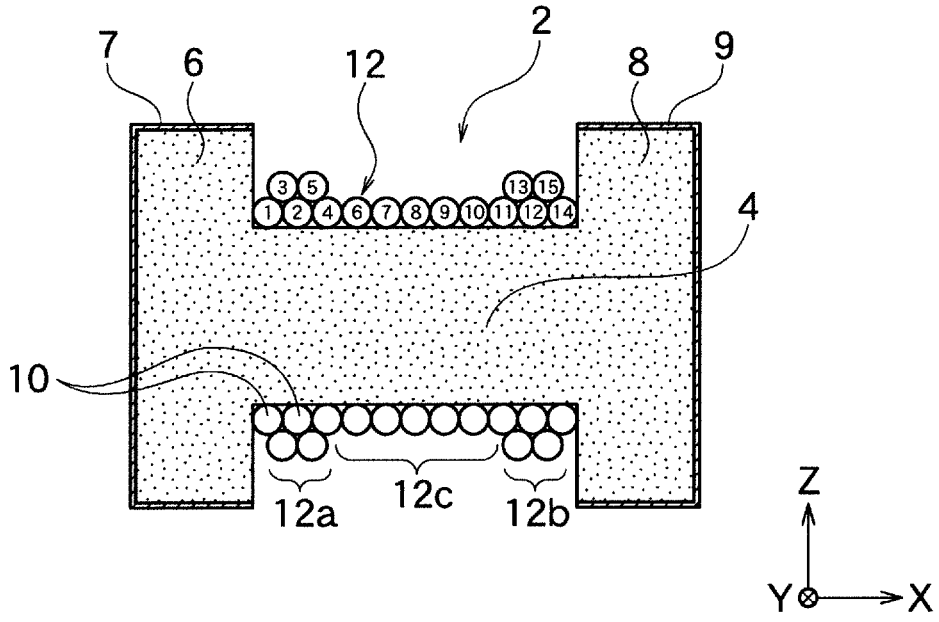
FIG. 2A is a cross sectional view along the II-II line of the coil device shown in FIG. 1A.

A coil device 2 according to an embodiment of the present invention shown in FIG. 1A to FIG. 1D is used a signal system coil, such as common mode filter, inductor, bead, or the like. As shown in FIG. 2A, the coil device 2 includes a winding core 4 having an axial core in the X-axis direction, and a first flange 6 and a second flange 8 that are open magnetic circuit type and are respectively formed on both sides of the winding core 4 in the X-axis direction. Incidentally, the X-axis, the Y-axis, and the Z-axis are vertical to each other in the figures.

An individual wire 10 is wound around an outer circumference of the winding core 4 by single or double layer in a winding order of circled numbers shown in FIG. 2A (each circled number shows an order of turn). In the illustrated embodiment, the individual wire 10 is spirally wound around the outer circumference of the winding core 4 so as to constitute a coil portion 12.

A first end 10*a* of the wire 10 is electrically connected to a top end surface in the Z-axis direction of a first terminal electrode 7 formed on an outer surface of the first flange 6 and is fixed. A second end 10*b* positioned on the opposite side of the first end 10*a* of the wire 10 is electrically connected to a top end surface in the Z-axis direction of a second terminal electrode 9 formed on an outer surface of the second flange 8 and is fixed. This electrical connection is made by any method, such as brazing, soldering, laser welding, and conductive adhesive.

The wire 10 may be any wire, such as resin coated wire and twisted wire. For example, the resin coated wire is a wire where a copper core wire is coated with a resin (coating material), such as polyurethane and polyester. The wire 10 has any diameter, but preferably has φ 0.01 to φ 0.1 mm.

The winding core 4 and the pair of flanges 6 and 8 are integrally formed as a drum core, and may be constituted by a magnetic body such as ferrite and metal magnetic body or by a nonmagnetic body such as alumina and ceramic. The drum core is preferably constituted by a magnetic body material whose specific permeability μ is preferably 50 or more, more preferably 100 or more, and particularly preferably 200 or more.

For example, the terminal electrodes 7 and 9 can be formed in a manner that a conductive paste containing silver, copper, gold, tin, nickel, and the like is applied to the outer surfaces of the respective flanges 6 and 8 and baked. The terminal electrodes 7 and 9 may be formed by plating or so.

In the present embodiment, the coil device 2 has any size, but preferably has a size of an X-axis direction length of 0.4 to 10.0 mm, a Y-axis direction width of 0.2 to 5.0 mm, and a Z-axis direction height of 0.2 to 5.0 mm. The winding core 4 wound by the wire 10 preferably has an X-axis direction length of 0.1 to 2.5 mm.

In the present embodiment, as shown in FIG. 2A, the coil portion 12 is formed around the outer circumference of the winding core 4. The coil portion 12 includes a first bank winding portion 12*a*, a second bank winding portion 12*b*, and a layer winding portion 12*c*. The first bank winding portion 12*a* is arranged closely and adjacently to the first flange 6. The second bank winding portion 12*b* is arranged closely and adjacently to the second flange 8. The layer winding portion 12*c* is arranged between the bank winding portions 12*a* and 12*b*. The first bank winding portions 12*a* and the second bank winding portion 12*b* are respectively formed by a double bank winding. The layer winding portion 12*c* is formed by a single layer winding. The first bank winding portions 12*a*, the second bank winding portion 12*b*, and the layer winding portion 12*c* are constituted by the continuous and individual wire 10.

The wire 10 is turned (winding operations) in the order of circled numbers shown in FIG. 2A so that the first bank winding portions 12*a*, the layer winding portion 12*c*, and the second bank winding portion 12*b* are adjacently closely wound around the outer circumference of the winding core 4 along the axial direction of the winding core 4 from the first flange 6 to the second flange 8.

That is, in the present embodiment, the wire 10 is wound around the winding core 4 adjacent to the first flange 6 at a first turn in a first layer, and the same wire is thereafter wound at a second turn in the first layer next to the first turn. Then, in the present embodiment, a third turn is not performed in the first layer next to the second turn, but a winding portion in a second layer is wound between the two wire winding portions of the first and second turns in the first layer so as to form a third turn. Thereafter, the wire 10 is returned to the first layer and wound next to the second turn so as to form a fourth turn, and a winding portion in the second layer is formed as a fifth turn. The first bank winding portion 12*a* with double layer can be formed by repeating these operations.

After the wire 10 is wound around the outer circumference of the winding core 4 so as to form the first bank winding portion 12*a*, the same wire 10 is closely wound by single layer (single-layer layer winding) around the outer circumference of the winding core 4 positioned next to the first bank winding portion 12*a* with double layer. In an example of FIG. 2A, the single-layer layer winding is from a sixth turn to a 10th turn. In the single-layer layer winding, the wire 10 is simply sequentially wound around the outer circumference of the winding core 4 from the first flange 6 toward the second flange 8.

The winding method is changed from the layer winding to a second bank winding at an outer circumferential position of the winding core 4 corresponding to a predetermined space from the second flange 8 in the X-axis direction. In the second bank winding, the wire 10 is wound at a 11th turn in the first layer around the winding core 4 positioned next to the wire 10 at the 10th turn wound in the layer winding, and the same wire 10 is wound at a 12th turn in the first layer next to the 11th turn.

Then, in the present embodiment, a 13th turn is not performed in the first layer next to the 12th turn, but a winding portion in the second layer is subsequently wound between the two wire winding portions of the 11th turn and the 12th turn in the first layer so as to form a 13th turn. Thereafter, the wire 10 is returned to the first layer and wound next to the 12th turn so as to form a 14th turn, and a winding portion in the second layer is then formed at a 15th turn. The second bank winding portion 12*b* with double layer can be formed by repeating these operations.

In comparison with a coil device entirely having only a layer winding portion with single layer along an axial direction, the coil device 2 according to the present embodiment can improve inductance by axially combining the bank winding portions 12*a* and 12*b* with double layer and the layer winding portion 12*c* with single layer. In addition, the coil device 2 according to the present embodiment can move a self-resonant frequency (SRF) to the side of high frequency.

The reason why a self-resonant frequency (SRF) can be moved to the side of high frequency in the coil device 2 according to the present embodiment is not necessarily clear, but can be explained as below.

That is, in the bank winding portions 12*a* and 12*b* with double layer, the wire 10 can be wound around the outer circumference of the winding core 4 along an advancing direction of a winding axis by repeating the turns in the second layer and the turns in the first layer. In the layer winding 12*c* with single layer, the wire 10 can be continuously and closely wound around the outer circumference of the winding core 4 along the advancing direction of the winding axis.

In the present embodiment, unlike a conventional coil device 2A where a wire is wound in a second layer after continuously forming a first layer (see FIG. 2C), a wire winding portion in a third layer does not need to be formed in the winding portion (coil portion 12) of the wire 10 going from one of the pair of flanges 6 and 8 arranged on both sides in the axial direction of the winding core 4 to the other. It is thus conceivable that the coil device 2 of the present embodiment can reduce an inter-line capacity even in case of the same winding number and shift a self-resonant frequency (SRF) to the side of high frequency.

A self-resonant frequency normally moves to a low frequency if a coating material of a wire has a small thickness. The coil device 2 can reduce a thickness of the coating material of the wire 10 if a self-resonant frequency (SRF) can be shifted to the side of high frequency. The coil device 2 is thus advantageous for increasing a winding number in a limited space and L value, miniaturizing a product, and the like. Thus, the coil device 2 of the present embodiment can be preferably used for a winding signal coil, a winding power supply coil, or the like.

Figure 2B:
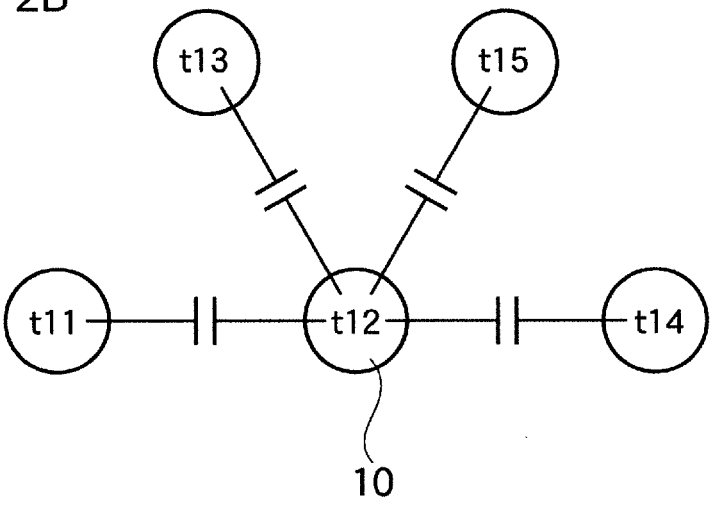
FIG. 2B is a schematic view for describing an inter-line capacity of a wire positioned at a certain turn in the coil device shown in FIG. 2A.
Figure 2C:
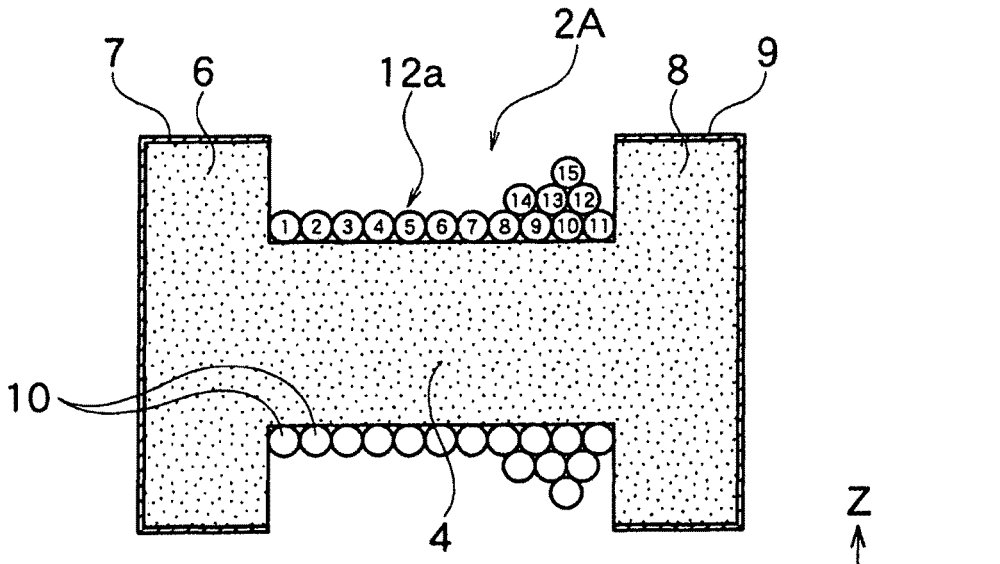
FIG. 2C is a cross sectional view of a conventional coil device.
Figure 2D:
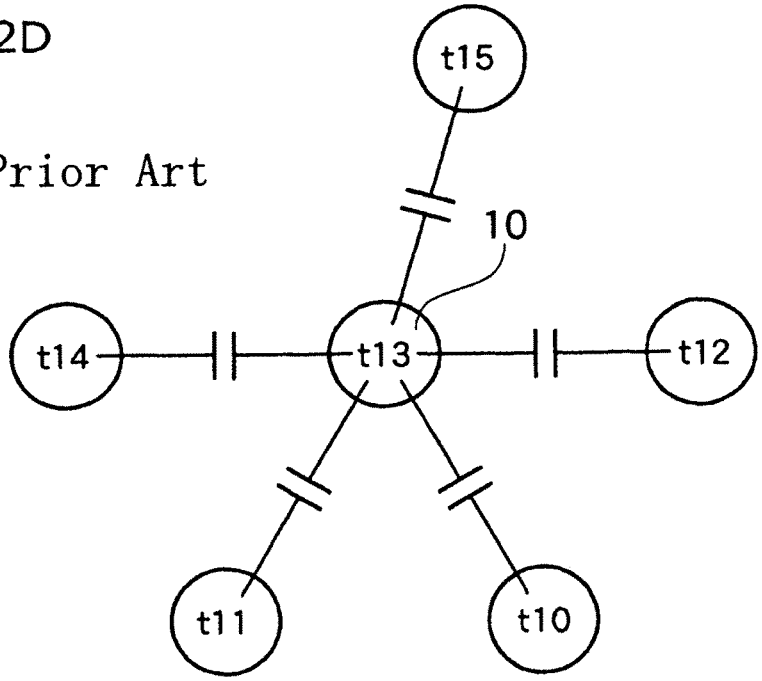
Prior Art FIG. 2D
FIG. 2D is a schematic view for describing an inter-line capacity of a wire positioned at a certain turn in the coil device shown in FIG. 2C.

Incidentally, a coil portion 12*a* is formed by a conventional winding method in the conventional coil device 2A shown in FIG. 2C. Thus, a wire 10 that cannot be wound in a first layer (turn numbers exceeding a 11th turn) is rewound in a second layer (from a 12th turn to a 14th turn). Thus, the wire 10 is wound at a 15th turn in a third layer so that a lead end of the wire 10 goes to a terminal 9 formed on a second flange 8. Thus, it is conceivable that a self-resonant frequency is conventionally hard to shift to the side of high frequency due to increase in inter-line capacity FIG. 2D is a schematic view showing an inter-line capacity around the wire 10 at the 13th turn in FIG. 2C, and FIG. 2B is a schematic view showing an inter-line capacity around the wire 10 at the 12th turn in FIG. 2A. The reason why the 13th turn is selected in FIG. 2C is that an inter-line capacity around the wire 10 at the 13th turn is conceivably largest of all of the turns. The reason why the 12th turn is selected in FIG. 2A is that an inter-line capacity around the wire 10 at the 12th turn is conceivably largest of all of the turns.

As understood from comparison between FIG. 2B and FIG. 2D, an inter-line capacity of FIG. 2D is larger than that of FIG. 2B. In the present embodiment, this is conceivably the reason why a self-resonant frequency can be shifted to the side of high frequency even in case of the same turn number (winding number) in comparison with the conventional example.

Figure 3:
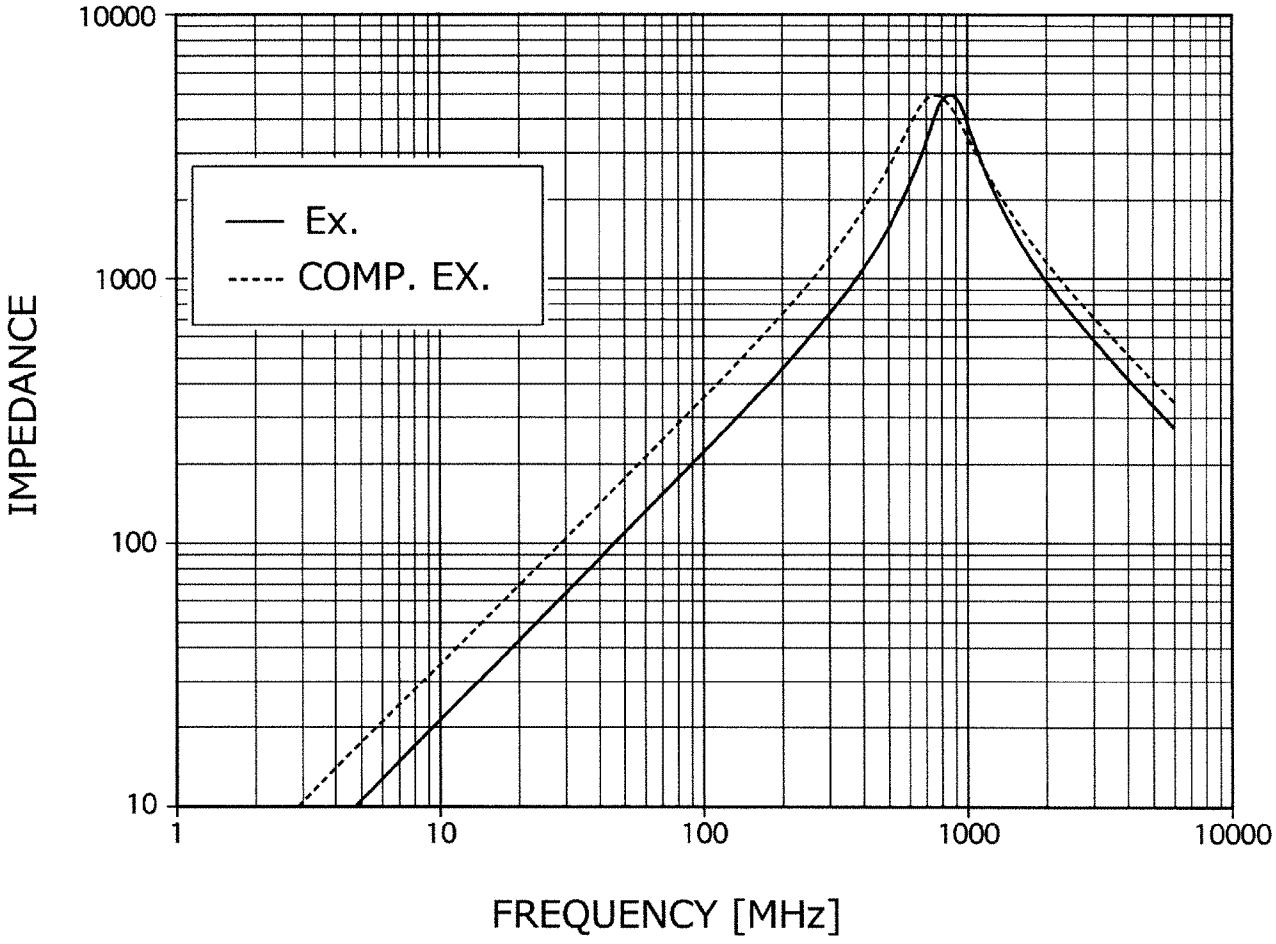
FIG. 3 is a graph showing a relation between a self-resonant frequency of a coil device according to Example of the present invention and a self-resonant frequency of a coil device according to Comparative Example.

FIG. 3 shows a graph comparing impedance properties for frequency of the coil device according to the present embodiment shown in FIG. 2A with impedance properties for frequency of the coil device according to a comparative example (conventional example) shown in FIG. 2C. As shown in FIG. 3, it is confirmed that a self-resonant frequency can be shifted to the side of high frequency even in the same turn number (winding number) in the present embodiment in comparison with the comparative example. Incidentally, the total turn number (winding number) of the wire 10 for obtaining the result shown in FIG. 3 is 18. The turn number of the first bank winding portion 12*a* with double layer is one (only the number in the second layer), and the turn number of the second bank winding portion 12*b* with double layer is one (only the number in the second layer).

The first bank winding portion 12*a* and the second bank winding portion 12*b* are respectively close to the first flange 6 and the second flange 8 in the present embodiment. In the vicinities of the flanges 6 and 8, the flanges 6 and 8 function as a wall, the bank winding for forming the bank winding portions 12*a* and 12*b* is easily performed, and a continuous winding operation is easily made without winding collapse.

Furthermore, the coil portion 12 includes the first bank winding portion 12*a*, the layer winding portion 12*c*, and the second winding portion 12*b* arranged in this order along the axial direction of the winding core 4 from the vicinity of the first flange 6 to the vicinity of the second flange 8 in the present embodiment. This configuration facilitates a continuous winding operation.

Furthermore, the turn number (axial length) of the first bank winding portion 12*a* and the turn number (axial length) of the second bank winding portion 12*b* are approximately the same in the present embodiment. In this configuration, the flow of the electric current from one side to the other side of the individual wire 10 constituting the coil portion 12 and the flow of the electric current from the other side to one side of the wire 10 are approximately the same, and thus the coil device 2 has no directionality and has an improved usability.

Incidentally, the present invention is not limited to the above-mentioned embodiment, but may be variously changed within the scope of the present invention.

For example, a lateral cross sectional shape (a cross sectional shape including the Y-axis and the Z-axis) of the winding core 4 is not limited to an approximately square shape, but may be another polygon, a circle, an ellipse, or another shape. A lateral cross sectional shape of the flanges 6 and 8 is not limited to a square either, but may be another polygon, a circle, an ellipse, or another shape.

The thickness in the X-axis direction of the first flange 6 and the thickness in the X-axis direction of the second flange 8 may be the same or different, and are a thickness capable of maintaining strength. The winding core 4 has a lateral cross sectional area that does not change along the X-axis direction in the present embodiment, but the lateral cross sectional area may change to be largest in the middle part in the X-axis direction, for example.

Furthermore, the first bank winding portion 12*a* and the second bank winding portion 12*b* are constituted by the same turn number in the above-mentioned embodiment, but may be constituted by different turn numbers. One of the bank winding portions 12*a* and 12*b* may not exist. The arrangement position of the bank winding portions is not limited to the vicinities of the flanges 6 and 8. Three or more bank winding portions may be arranged along the axial direction of the winding core 4.

In any case, in the coil device according to the present embodiment, the wire is not closely wound around the outer circumference of the winding core in the first layer and then transferred to the second layer, but the bank winding portions are formed by performing a bank winding at the start of winding the wire, at the end of winding the wire, or in the middle of winding the wire in the first layer. The turn number in the bank wining portions with double layer is preferably 2 to 6 (number only in the second layer). The turn number in the layer winding portion with single layer is preferably 3 to 30.

NUMERICAL REFERENCES

2, 2A . . . coil device
4 . . . winding core

6 . . . first flange
7 . . . first terminal electrode
8 . . . second flange
9 . . . second terminal electrode
10 . . . wire
10*a* . . . first lead end
10*b* . . . second lead end
12 . . . coil portion
12*a* . . . first bank winding portion
12*b* . . . second bank winding portion

The invention claimed is:

1. An inductor comprising:

a winding core with a coil portion wound by a continuous and individual wire; and a pair of flanges formed on respective ones of two sides of the winding core in an axial direction, wherein the coil portion includes a first bank winding portion and a second bank winding portion both with double layer constituted by the continuous and individual wire wound around, respectively, two outer circumferences of the winding core and a layer winding portion with single layer constituted by the same wire as the continuous and individual wire wound closely and adjacently to the bank winding portions along the axial direction of the winding core, and wherein the coil portion comprises the first bank winding portion, the layer winding portion, and the second bank winding portion in this order along the axial direction of the winding core from one of the flanges to near the other flange.

2. The inductor according to claim 1, wherein an axial length of the first bank winding portions and an axial length of the second bank winding portion are approximately the same.

* * * * *